US008207855B2

(12) United States Patent
Westerlund et al.

(10) Patent No.: US 8,207,855 B2
(45) Date of Patent: Jun. 26, 2012

(54) COMMUNICATION APPARATUS, SYSTEM AND METHOD FOR SELF-CONTAINED BREATHING APPARATUS

(75) Inventors: Mikael Westerlund, Karjaa (FI); Hasse Sinivaara, Tuusula (FI)

(73) Assignee: Savox Communications Oy Ab (Ltd), Espoo (FI)

( * ) Notice: Subject to any disclaimer, the term of this patent is extended or adjusted under 35 U.S.C. 154(b) by 513 days.

(21) Appl. No.: 12/440,502

(22) PCT Filed: Sep. 6, 2007

(86) PCT No.: PCT/FI2007/000224

§ 371 (c)(1), (2), (4) Date: May 11, 2009

(87) PCT Pub. No.: WO2008/028995

PCT Pub. Date: Mar. 13, 2008

(65) Prior Publication Data

US 2010/0039229 A1 Feb. 18, 2010

(30) Foreign Application Priority Data

Sep. 8, 2006 (FI) ..... 20060802

(51) Int. Cl.
*G08B 13/14* (2006.01)

(52) U.S. Cl. ..... 340/572.1; 340/572.4; 340/573.1

(58) Field of Classification Search ..... 340/572.1, 340/572.4, 572.8, 573.1, 573.3, 539.1, 539.11, 340/539.13, 5.7, 5.92, 10.1; 128/201.19, 340/204.23; 342/457

See application file for complete search history.

(56) References Cited

U.S. PATENT DOCUMENTS

| | | | |
|---|---|---|---|
| 5,404,577 | A | 4/1995 | Zackerman et al. |
| 6,121,881 | A | 9/2000 | Bieback et al. |
| 2002/0008625 | A1 | 1/2002 | Adams et al. |
| 2006/0273894 | A1 | 12/2006 | Goehler |

FOREIGN PATENT DOCUMENTS

| | | |
|---|---|---|
| GB | 2 336 319 | 10/1999 |
| WO | 03/103773 | 12/2003 |

OTHER PUBLICATIONS

International Search Report dated Jan. 9, 2008, from corresponding PCT application.

*Primary Examiner* — Van T. Trieu
(74) *Attorney, Agent, or Firm* — Young & Thompson

(57) ABSTRACT

A self-contained breathing apparatus safety mask, a system and a method includes a radio frequency identification tag reader arranged to communication with a radio frequency tag so that the breathing apparatus can obtain an identification of the user for wireless radio group communication with breathing apparatuses of other users. The identifier contains information for establishing and changing the group communication parameters. The system also includes a remote speaker microphone in short range radio communication with the mask. The remote speaker microphone may be connected to private mobile system.

21 Claims, 5 Drawing Sheets

COMMUNICATION APPARATUS, SYSTEM AND METHOD FOR SELF-CONTAINED BREATHING APPARATUS

TECHNICAL FIELD OF THE INVENTION

The invention concerns a self-contained breathing apparatus arranged to a wireless group communication with identification tag. Furthermore the invention concerns a wireless group communications system for the breathing apparatus. Yet furthermore the invention concerns a method for wireless group communications with the safety masks on a basis of identification tag.

BACKGROUND ART

Communication between fire fighters wearing a self-contained breathing apparatus, such as a safety face mask, for example, is extremely difficult under the best conditions and almost impossible in most fire situations. Fire fighters must yell through their masks or use elaborate hand signals, or in some cases, may even remove their mask, just to be able to talk to each other.

Since fire fighting often requires split-second decision making, often with serious consequences at stake, there is a need for rapid and coherent communication to avoid exposing fire fighters and the public to undue risk.

Existing mechanisms typically employ a microphone which is "push-to-talk" activated and coupled via an interface box and corded link to a speaker placed in proximity to a wearer's ear, thereby providing a walkie-talkie type arrangement. A wearer of the self-contained breathing apparatus must push a button to talk into the microphone, which requires that the wearer can only have one hand free while talking into the apparatus. Moreover, a voice signal picked up by the microphone is usually amplified to be presented to a speaker of another user, which often picks up interference in the form of ambient noise encountered in most fire situations. This interference can cause false triggering of voice detection circuitry. In addition, the geometry of the cavity inside the self-contained breathing apparatus enhances low frequencies, making analog voice signals virtually unintelligible. The cord connecting the microphone and speaker to the interface box can often frustrate a user as it can become entangled in other fire fighting equipment or the user's clothes, or it may loosen and become detached, preventing communication between fire fighters. In short the cord can be a safety hazard. In addition, the absence of communication with a fire fighter may indicate that the fire fighter is in a dangerous situation and that the other members of the crew should locate and help the person in need, possibly in a smoke-filled room with zero visibility.

A known fire fighter's communications apparatus, system and method is disclosed in patent application WO 03/103773 A1. A method of facilitating communications for a wearer of a mask, such as a fire fighter's breathing apparatus, involves receiving a removable transmitter apparatus in a receptacle in the mask, to permit the transmitter apparatus to receive acoustic utterances made by the wearer of the mask and to transmit electromagnetic radiation representing the utterances for reception by a receiver. The receiver, which is positioned at the waist of the fire fighter, receives the electromagnetic radiation and broadcasts an audible reproduction of the acoustic utterances. The receiver may be supported by a wearer of the mask so that listeners in the vicinity of the wearer can hear the utterances. A plurality of wearers of masks may each have the apparatus described above to create a mobile public address system in which the utterances of a plurality of wearers may be broadcast from each wearer to other people in the vicinity of the wearers.

However the known system, apparatus and the method have problems in particularly for group communication and/or data transport. Also, there's no automated voice communication i.e. user must perform some level of manual activation to open the channel and sometimes that is not possible when the alarm is on. However the major problem is that the wireless, i.e. radio, communications between the breathing apparatus (i.e. fire fighter's mask) and the worn receiver of the breathing apparatus is only one-way communications. This emerges major difficulties in group and data communications for modern safety and emergency equipments.

Another known protective mask communication device and system is known from a patent publication U.S. Pat. No. 6,121,881. The systems allow wearers of protective masks working in a hazardous area to readily communicate both with each other and with personnel and automated systems outside of the area. Preferred systems provide Bluetooth communications between mask wearers. Furthermore the mask has a higher power transceiver communicating to and from a remote transceiver located further than the other masks. The higher power communications is used to identify the mask and is actuated by an actuator in the mask.

However the Bluetooth transmission between the safety masks is too weak and has too small coverage in order to allow fire fighters to work effectively. Typical coverage range of Bluetooth is so small that the fire fighters may easily drift away from the coverage range of the mask communication system, thereby losing contact with the group. This is a clear safety hazard. However major problem is the actual group creation. In particularly problem arise when establishing or changing the group composition or use conditions. For example the group composition may be needed to change or amend, even on the fly, group members (remove or add fire fighters), rename the group, use different frequencies, channels or transmission power, use different network parameters, etc. This is particularly relevant for real-time safety hazard situations such as during the fire accident.

SUMMARY

It is therefore the object of the invention to better provide breathing apparatuses with multiple wireless group communications.

In accordance with an aspect of the invention there is provided a breathing apparatus for a user, comprising radio frequency identification tag reader arranged to communication with a radio frequency tag so that the breathing apparatus can obtain an identification of the user for wireless radio group communication with breathing apparatus of another user.

In accordance with another aspect of the invention there is provided a system comprising:

a low power communication device, a safety mask for a user arranged to higher power communication with another safety mask, wherein the safety mask and the low power communication device are arranged to communicate with each other, and a radio frequency identification tag reader arranged to communicate with a radio frequency tag so that the safety mask can obtain an identification of the user for wireless radio group communication with the another safety mask.

In accordance with another aspect of the invention there is provided a method for group communication comprising:

obtaining radio frequency identification tag based data information, establishing a wireless two-way data radio connection between at least two safety masks in accordance with said data information.

Various embodiments of the invention contain a radio frequency identification system such as RFID (i.e. RFID tag). The RFID is used to parameterize the radio communication system. Furthermore RFID can be used to change group channel allocation. Furthermore the identification can be used to activate the system. Yet furthermore the identification can be used to give identification for the breathing apparatus or the RSM device.

Various embodiments of the invention relate to the breathing apparatus, i.e. the safety mask comprising wireless radio data communication systems. An example of the breathing apparatus is a fire fighter's safety fire mask. The breathing apparatus can be facilitated with a number of RF systems to host different means of communication that is used in a fire fighter group and/or between fire fighters and group leaders. Different technology can be used depending on the link and the receiver. Various embodiments are capable of transporting both audio and data, depending on the use scenarios.

In various embodiments the breathing apparatus hosts generally three wireless radio communication systems for multiple purposes. There can be several different alternatives to use, which are then allocated for certain communication path, and accordingly become operable for that purpose.

In the embodied systems main communication links are the group communications between the users such as the fire fighter group. Typically the system includes capacity for average 20-30 persons, but higher number of users can be used. Also a level of data transport can be adjusted accordingly. The system can thus have a high channel throughput capacity and also potentially number of frequencies to be used and allocated for a number of groups. The coverage is about 50 meters, preferably minimum, at indoor environment and system can be an ad-hoc capable. The system can, for example, be based on 802.11a/b/g and 802.15.3/4 technologies. Also UWB technology may be used.

Thus the first wireless communications link is between two breathing apparatuses. Another link is the link from the breathing apparatus to the second wireless short range communications units, which can be attached to user's waist. An example of the second unit is a remote speaker microphone RSM type of device that is typically cable connected to the TETRA type of terminals or other digital and analog radio standard devices. The second unit is used primarily for communicating outside group. For example the breathing apparatus is Bluetooth connected to the second unit such as RSM device and through TETRA radio communication outside the group.

Various embodiments establish a personal fire fighter communication system where group communication is used as a primary function. Secondary communication is used in a PTT (Push-To-Talk) mode when the PTT is activated in the breathing apparatus's Bluetooth or similar link, thereby activating communications between the breathing apparatus and the RSM device. Alternatively the PTT function can be replaced with Voice recognition technology where system can include a "key word" for team radio access or RSM link access. Functional wise fire fighter can say the "key word" and the system activates the correct radio link accordingly. This technology is well known and implemented e.g. in GSM/3G phones as voice tags. Only difference is that in this system the alternative wording will activate certain pre-programmed RF system. In case voice recognition is used, PTT switches can be removed and the system becomes fully autonomous in transporting audio on-line. Accordingly the audio transport is enabled outside the team. Generally one radio is active, for example when the group communication is active the PTT link is in idle state. When PTT (by switching PTT or using voice recognition) is activated the group radio goes into idle state accordingly. When communication towards team is originated from outside, the RSM devices wireless link activates the connection between RSM device and mask unit. This activation will force the team radio into idle state as far as communication through RSM link is active. This communication can be routed to each team member individually or to whole team. While this link is active and team link is in idle state, no voice activated link needs to be used. Primarily system can use topology such that after RSM link is switched to idle state after communication, the mask system switches automatically into team link.

The RFID can be used when the parameterization and/or identification is performed.

Advantageously various embodiments of the invention allow broader communication means for fire fighter, being also a safety issue. Communication is partially fully automated and can be online. Especially the communication is more automatic when using the communication within the group. Furthermore also links to outside the group exists for sending or getting additional information. Various radio embodiments are fully wireless. For example they simplify the wearable parts for fire fighters. Thus cables can be replaced that is a clear safety issue.

Furthermore various embodiments of the invention help to mitigate the required manual actives of fire fighters, and are more automated by means of voice/data transmission.

Especially various embodiments provide means for identification, upgrading the different group parameters, changing channel or group allocation and also enabling to change the geographical parameters, which are set by the frequency regulators. The multiple radios are operating dynamically and used in a situation that the user is selecting or acting on.

BRIEF DESCRIPTION OF THE DRAWINGS

The invention will now be described, by way of examples only, with reference to the accompanying drawings, in which.

DESCRIPTION OF VARIOUS EMBODIMENTS OF THE INVENTION

Figure 1:
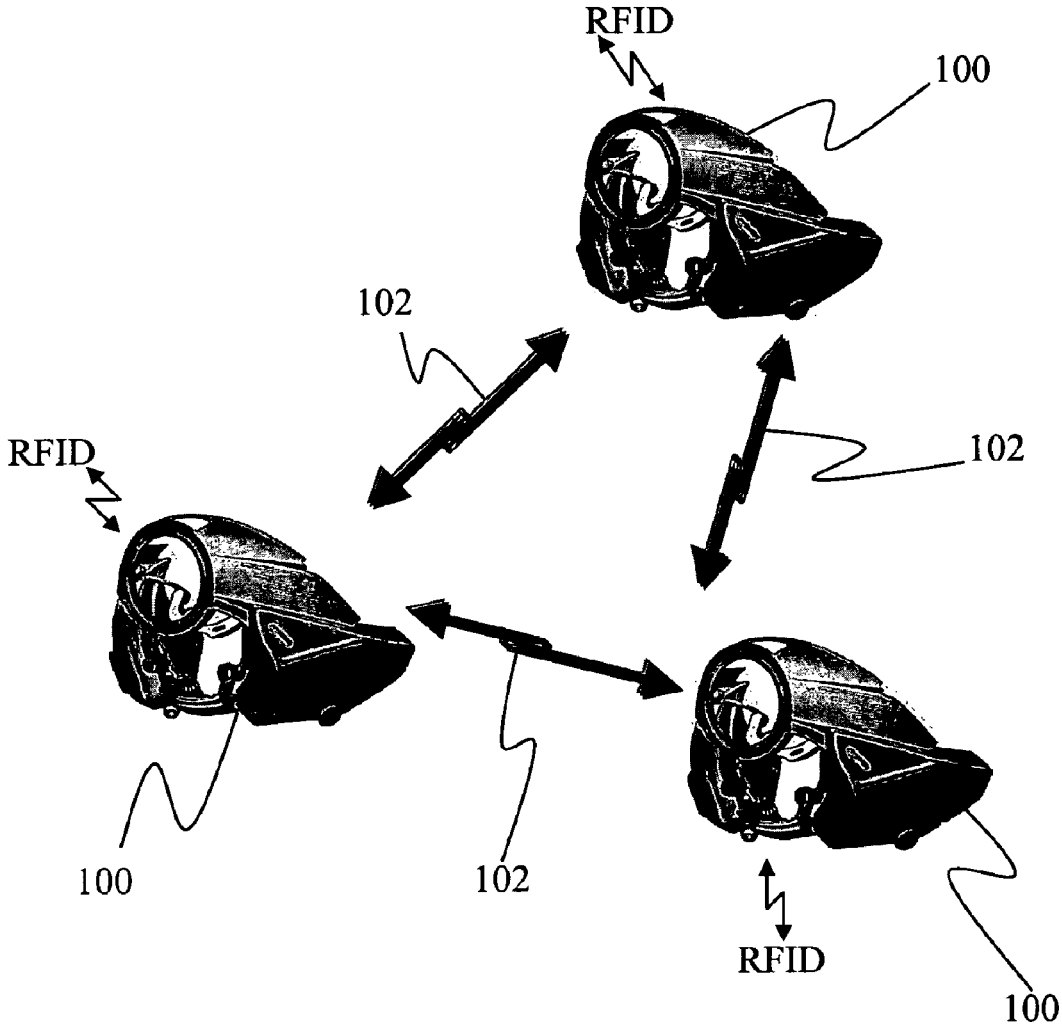
FIG. 1 depicts breathing apparatuses in wireless radio group communication system in accordance with various embodiments of the invention.
Figure 2:
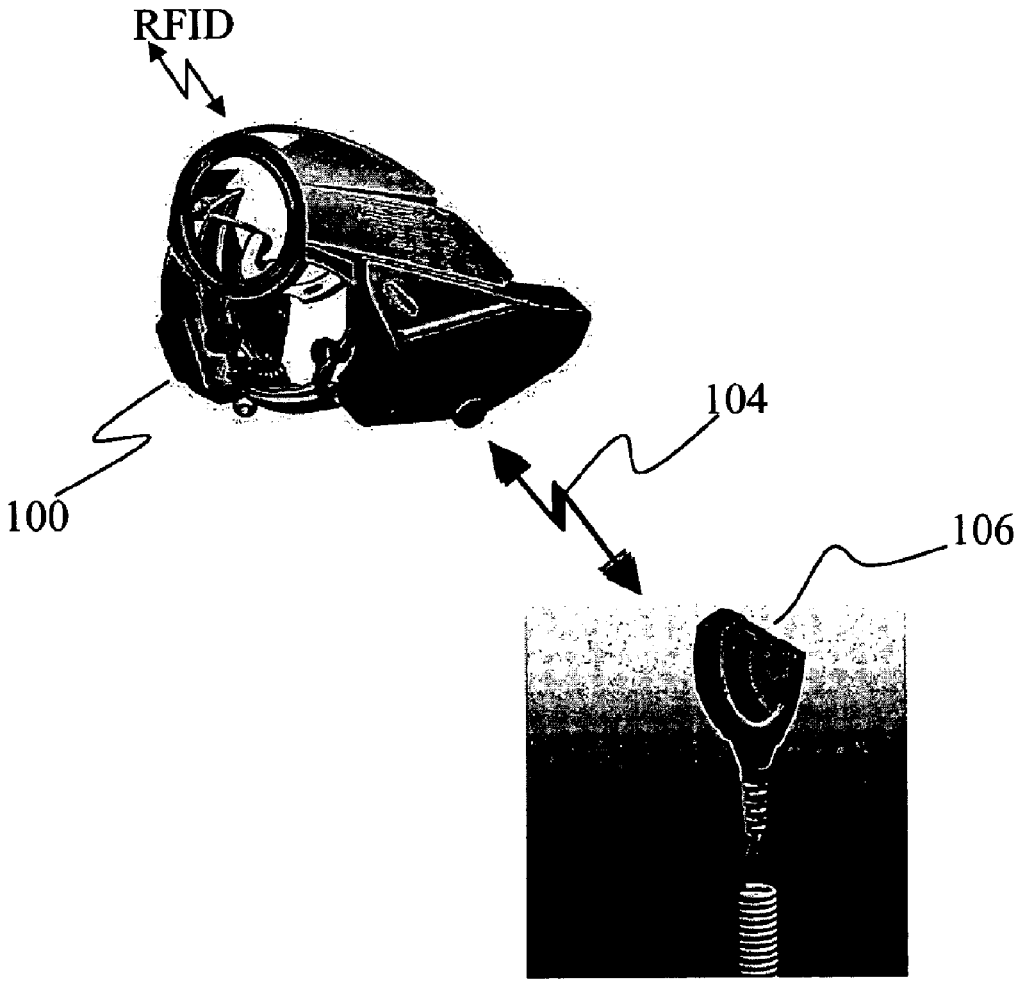
FIG. 2 depicts a breathing apparatus communicating with a RSM unit by a short range wireless radio communications link in accordance with various embodiments of the invention.
Figure 3:
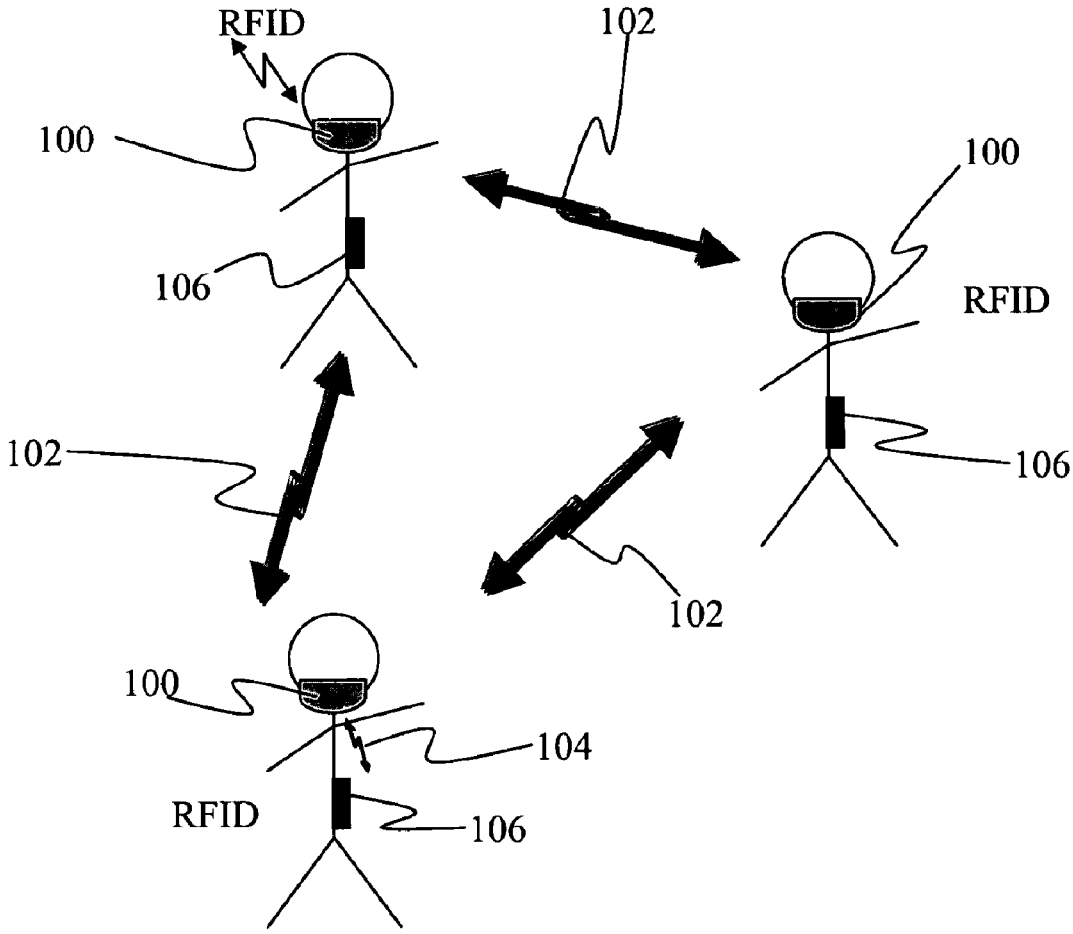
FIG. 3 depicts fire fighter group communicating with each other by the breathing apparatuses and RSM units in accordance with various embodiments of the invention.
Figure 4:
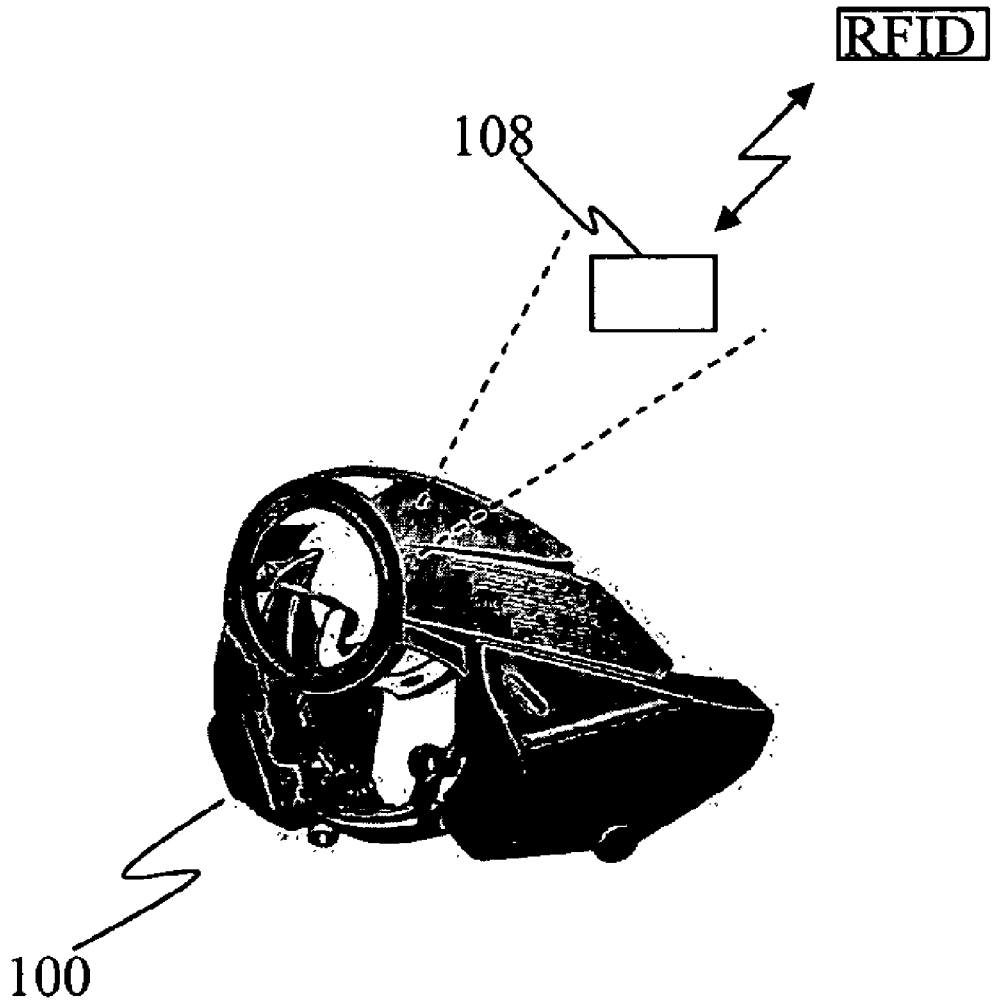
FIG. 4 depicts a breathing apparatus containing RFID tag reader communicating with RFID tag in accordance with various embodiments of the invention.
Figure 5:
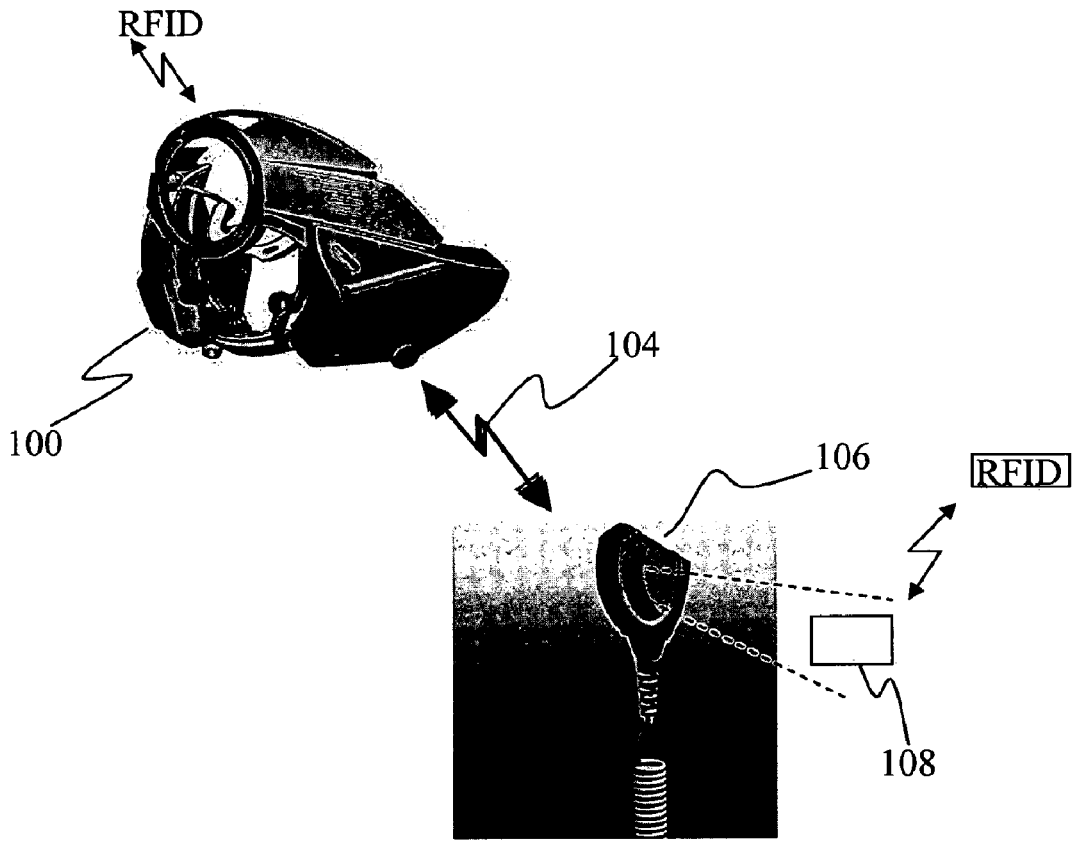
FIG. 5 depicts a system wherein breathing apparatus communicates with RSM device, which contains RFID tag reader communicating with RFID tag in accordance with various embodiments of the invention.

Various further embodiments of the invention are now described with reference to the FIGS. 1, 2, 3, 4 and 5.

Various embodiments of the invention include generally two individual products that will create at least a part of the communications system: a self-contained breathing apparatus 100 with a wireless radio communications unit (alternatively referred to as a safety mask, a safety mask communication unit, a fire fighter mask etc.) and a short range wireless radio communication unit 106 attachable to user's waist (alternatively referred to as a remote speaker microphone RSM, RSM unit, RSM device, etc.). The breathing apparatuses 100 communicate through wireless radio communications 102 with each other. Thus the breathing apparatus 100 comprising the unit communicates with other breathing apparatuses 100 through wireless team radio 102. The RSM unit 106 is cable connected to the Mobile radio (e.g. TETRA phone). The RSM unit 106 communicates through short range wireless radio communications 104 with the breathing apparatus 100.

Breathing Apparatus

The breathing apparatus 100 comprises a self-contained breathing apparatus. In various embodiments the breathing apparatus can be a protective mask having a communication device for use in hazardous environments. The protective is adapted to be worn over a person's face and to supply air to the wearer. The breathing apparatus may or may not contain the RFID tag reader 108.

The breathing apparatus 100 with the communications unit is battery operated, currently 9V ATEX certified battery.

Group Radio

The communications 102 between the breathing apparatuses 100 is generally carried out by wireless data communications radio 102 in various embodiments of the invention. The wireless communications radio 102 can be either WLAN based, for example (802.11a ad-hoc), or similar 802.15.3/4 type of connection. General coverage range is about 50-60 m range in indoors, support for up to 20 simultaneous users per group (with a main function with audio transmission). Advantageously the embodied system can also support routing function in case that some of the group members does not sense all parties in a group. Thus certain members have to act as a routing node for broadcast transmission/reception. Including routing method into MAC level can do the routing. Alternatively the routing can be done in the application level. In this case a routing function is used to control the TCP/IP properties.

The group radio, by the wireless radio communications 102, is also able to transport data information. For example each member can share any data information that each individual is carrying. This could be e.g. some head-up display stream or individual biometric information, identification etc.

The system has simple ON-OFF switch which will automatically activate the group radio 102 in its selected group. For example, the breathing apparatus 100 or the RSM device 106 contains the switch. The change of the group is explained later. Typically once the radio has been parameterized, it will authenticate itself into that group. The communication link 102 is generally always on and utilises the standard means of transmitting.

Voice Activated Transmission

Some embodiments of the invention uses voice activated transmission VoX. It can be used to control the system transmit times. Thus it will have advantageous effects on battery life time. VoX is used to sense the fire fighter speech and Tx 102 is activated always when Vox sends a trigger pulse to Tx link. Typically each device, e.g. the breathing apparatus 100 or the RSM device 106, listens certain broadcast channel for audio/data transport. Vox can be used to minimise empty Tx packets. For example only the header or protocol is transmitted in time according to standard implementation and user data (when empty) is minimised from the Tx packets. Advantageously that will free up the channel capacity and speed up the system response time by having shorter protocol packages on air per time.

Additionally the system can also have Voice amplifier (VA) and DNR system implemented.

RSM Unit

Various embodiments of the invention disclose the RSM unit 106. The secondary wireless connectivity 104 is established between the breathing apparatus 100 and the RSM device 106. The connection 104 is through Bluetooth or equal short-range wireless radio connectivity. Also the main function is to transport audio up-down, thus by two-way communications. Generally the secondary wireless link 104 is in idle state at the times when the group/team radio is active. The secondary wireless link 104 is activated when the PTT button in the mask 100 is activated. Fire fighter may push the PTT button in the mask body, that will activate the link 104 from idle to Tx/Rx state and audio is routed through RSM device 106 and further on through e.g. TETRA terminal. The secondary wireless communications 104 can be advantageously used when communicating outside the group members. The link 104 activation has a very short delay, e.g. very short idle to active time with minimum amount of "extra trigger pushes/buttons". The RSM device 106 may or may not contain the RFID tag reader 108.

RFID

Various embodiments of the invention can use RFID. Third RF technology in the system is the RFID. RFID is used to parameterize the breathing apparatus communication system 102,104 to operate with other fire departments/districts that may have different channel/group allocation. RFID can be used to operate with different or specific groups giving appropriate channel and group allocation. RFID is for example used to have different ESSID network name list for grouping, and to separate different districts from each others, etc. This may also require having different channel allocation per each group in order to minimize frequency interference. Furthermore by this way advantageously the channel capacity can be increased and number of users increased. Some level of data could be transmitted as well, but still using audio as primary transport packets.

Each user, for example fire fighter, is handed with an identification that is containing RFID tag and RFID reader 108. The identification card RFID tag is be editable in station through a personal portal, or readable from other users. Typically the ID card holds information such as group name (ESSID or Network name), channel allocation for that group, IP network settings and country specific parameters (e.g. US vs. EU area frequency allocation+Tx power settings). Of course the parameters and information may vary. At the base, the parameters can be read into ID card through portal. The parameters can be edited through portal, or read from other users ID cards.

Because of fairly difficult pairing operation of the Bluetooth BT, also pairing information could be stored in the ID card. Since BT does not have any specific algorithm or method to select certain pair, the added functionality and parameter set could compensate this. Typically these parameters can be e.g. Bluetooth MAC addresses that are hardware coded in each unit. That specific MAC address is used in link establishment and MAC address is a device "identification" as such.

ID card could be hosting as well the RSM specific node information that is used for pairing the breathing apparatus 100 and the correct RSM unit 106. By giving the parity data to the mask 100, it will only pair with the specific RSM device 106, not by randomly selecting.

Activating the breathing apparatus 100 with correct settings requires the user to touch the breathing apparatus's communications unit where the antenna of the RFID reader 108 is located. The unit 108 reads the data from the ID card, pushes the settings to configuration database and activates the breathing apparatus 100 radios to operate into correct settings. This action can be triggered e.g. by adding a special button into the breathing apparatus 100 that is used to activate the RFID reader 108 in the communications unit. Advantageously this will save battery so that the RFID reader 108 does not have to be scanning in periodical cycle. Alternatively the breathing apparatus 100 is simply activated always when the breathing apparatus 100 is switched ON. After that there would a certain timer that the user has to touch the RFID reader 108 for data transport.

Additionally the RFID can contain additional information such as TETRA terminal group info, default talk group etc. Those could be transported through BT connection 104 established first time between the breathing apparatus 100 and the RSM device 106, parameter transport within initialization period (only changed if the database settings in the mask unit 100 is changed).

Thus there are several alternatives implementing the RFID in the system. The breathing apparatus 100 can comprise RFID tag and RSM RFID reader 108. The RSM device 106 can comprise RFID tag and the breathing apparatus 100 RFID tag. Furthermore the RFID tag can also be a separate id card. The RFID reader can be in either one of the breathing apparatus 100 and the RSM device, etc.

In an embodiment the RFID tag contains MAC address of the short range RF unit. That MAC address is used for forced pairing operation. Furthermore RFID tag can also contain IP address and broadcast IP addresses/multicast IP addresses for application detection level for future purposes.

An operation is such that whenever devices need to be paired, user activates the pairing. For example touches the headset of the breathing apparatus 100 with RSM device 106 (with external bottom module RFID reader 108) for a specific time. RFID reader 108 activates the magnetic field between the tag—the reader. The reader 108 reads the data from tag.

The data is then transported, for example into the RSM device communication database. The received MAC address is used for base for pairing. This step can also activate the RF radio itself in the RSM device 106. For example the RF systems can be in OFF-state until reading occurs. Advantageously this function can be used for power saving.

When short range RF then is activated in both ends 100, 106, the RF radios can scan only for that specific MAC address. The RSM device 106 picks the correct MAC from the list. Even though other MAC addresses could be found only that specific MAC is used for forced pairing.

Once both ends 100,106 have found each others, pairing and link establishment can be performed. These settings can be saved in both devices i.e. also headset RF can use that specific received MAC address for initial pair. But, in order to provide a "freedom", headset could be paired afterwards with other devices as well. Therefore it is not necessary to use the received MAC as forced entry in headset side i.e. only for activated links that received Mac address is used as a "base".

The further embodiment using the RFID allow safe pairing of devices 100 and 106 without the manual configuration or manual user interaction (except, of course the touching operation). Thus system is more automated network establishment between the RF devices 100,106. Also, this system can be used to power up-down other RF systems and therefore having power saving capabilities.

Ramifications and Scope

Although the description above contains many specifics, these are merely provided to illustrate the invention and should not be construed as limitations of the invention's scope. It should be also noted that the many specifics can be combined in various ways in a single or multiple embodiments. Thus it will be apparent to those skilled in the art that various modifications and variations can be made in the apparatuses and processes of the present invention without departing from the spirit or scope of the invention.

The invention claimed is:

1. A breathing apparatus for a first user, comprising:

a radio frequency identification tag reader arranged to communicate with a radio frequency identification tag so that the breathing apparatus can obtain an identification of the first user and a group identity of the first user for wireless radio group communication with a second breathing apparatus of a second user.

2. The breathing apparatus according to claim 1, wherein said radio frequency identification tag reader is arranged to obtain radio channel allocation for the wireless radio group communication.

3. The breathing apparatus according to claim 1, wherein said radio frequency identification tag reader is arranged to obtain group channel allocation for the wireless radio group communication.

4. The breathing apparatus according to claim 1, wherein said radio frequency identification tag reader is arranged to obtain frequency allocation for the wireless radio group communication.

5. The breathing apparatus according to claim 1, wherein said radio frequency identification tag reader is arranged to obtain transmission power settings for the wireless radio group communication.

6. The breathing apparatus according to claim 1, wherein said radio frequency identification tag reader is arranged to obtain identifier identifying said breathing apparatus for the wireless radio group communication.

7. The breathing apparatus according to claim 1, wherein said radio frequency identification tag reader is arranged to obtain IP network settings.

8. The breathing apparatus according to claim 1, wherein said radio frequency identification tag reader is arranged to obtain Bluetooth pairing data for establishing a Bluetooth connection between the breathing apparatus and a Bluetooth based device.

9. The breathing apparatus according to claim 1, wherein the wireless radio group communication between the breathing apparatuses comprises communication via a wireless local network (WLAN).

10. The breathing apparatus according to claim 1, further comprising:

at least one wireless radio communications unit arranged to the two-way wireless radio group communication with another wireless radio communications unit of the second breathing apparatus;

two-way short range wireless communication with a short range wireless communications unit attachable to said users; and short range wireless radio communication with the radio frequency identification tag.

11. The breathing apparatus according to claim 1, wherein the two-way short range wireless communication is further arranged to provide the breathing apparatus with communications with a mobile communications system such as TETRA.

12. The breathing apparatus according to claim 1, wherein said breathing apparatus comprises a self-contained breathing apparatus for a fire fighter.

13. The breathing apparatus according to claim 1, wherein a single device in the breathing apparatus is arranged to carry out the radio communications.

14. The breathing apparatus according to claim 1, wherein at least two or three devices in the breathing apparatus are arranged to carry out the radio communications.

15. The breathing apparatus according to claim 1, further comprising a detector to sense a speech of the user so that a transmission by the communications can be activated respectively.

16. The breathing apparatus according to claim 15, further comprising means for transmitting a header or protocol and substantially no data packet when the speech is not sensed.

17. A system comprising:

a low power communication device;

a first safety mask for a user arranged to higher power communication with a second safety mask, wherein the first safety mask and the low power communication device are arranged to communicate with each other; and a radio frequency identification tag reader arranged to communicate with a radio frequency identification tag so that the first safety mask can obtain an identification of the user for wireless radio group communication with the second safety mask.

18. The system according to claim 17, wherein said low-power wireless radio communication device is further arranged to communicate with a mobile communications system or TETRA.

19. The system according to claim 17, wherein the safety mask or the low power communication device comprises the radio frequency identification tag reader.

20. A method for group communications comprising:

obtaining radio frequency identification tag based data information, said information comprising an identification of a user and a group identity of the user; and establishing a wireless two-way data radio connection between at least two safety masks in accordance with said data information.

21. The method according to claim 20, further comprising:

establishing a short-range wireless two-way data radio connection between one of the safety masks and a terminal capable of mobile phone communications.

* * * * *